US010254060B2

(12) United States Patent
Hoon

(10) Patent No.: US 10,254,060 B2
(45) Date of Patent: Apr. 9, 2019

(54) MEANS FOR CONVERTING SEMI-AUTOMATIC FIREARM TO PUMP-ACTION RIFLE

(71) Applicant: Douglas Martin Hoon, Guilford, CT (US)

(72) Inventor: Douglas Martin Hoon, Guilford, CT (US)

( * ) Notice: Subject to any disclaimer, the term of this patent is extended or adjusted under 35 U.S.C. 154(b) by 169 days.

(21) Appl. No.: 15/356,596

(22) Filed: Nov. 20, 2016

(65) Prior Publication Data

US 2018/0142975 A1 May 24, 2018

Related U.S. Application Data

(60) Provisional application No. 62/258,444, filed on Nov. 21, 2015.

(51) Int. Cl.

| | |
|---|---|
| ***F41A 5/26*** | (2006.01) |
| ***F41A 9/52*** | (2006.01) |
| ***F41A 3/66*** | (2006.01) |
| ***F41C 7/02*** | (2006.01) |
| ***F41A 5/28*** | (2006.01) |
| ***F41A 3/72*** | (2006.01) |
| ***F41A 11/02*** | (2006.01) |

(52) U.S. Cl.

CPC ..... *F41A 9/52* (2013.01); *F41A 3/66* (2013.01); *F41A 3/72* (2013.01); *F41A 5/26* (2013.01); *F41A 5/28* (2013.01); *F41A 11/02* (2013.01); *F41C 7/02* (2013.01)

(58) Field of Classification Search

CPC ..... F41A 5/26; F41A 5/28; F41A 5/18; F41A 5/20; F41A 9/52; F41C 7/02

USPC ..... 89/128, 193, 191.01, 191.02

See application file for complete search history.

(56) References Cited

U.S. PATENT DOCUMENTS

| | | | | |
|---|---|---|---|---|
| 987,350 | A * | 3/1911 | Febiger | F41A 11/02 42/16 |
| 988,996 | A * | 4/1911 | Frommer | F41A 5/14 89/128 |
| 2,341,260 | A * | 2/1944 | Barnes | F41A 5/18 42/17 |
| 4,395,937 | A * | 8/1983 | Ottolini | F41C 7/02 89/128 |
| 4,538,502 | A * | 9/1985 | Benelli | F41C 7/02 89/128 |
| 5,503,137 | A * | 4/1996 | Fusco | F41B 11/62 124/56 |
| 7,946,214 | B2 * | 5/2011 | Stone | F41A 5/18 89/193 |
| 8,061,260 | B2 * | 11/2011 | Kenney | F41A 5/26 89/193 |
| 8,065,949 | B1 * | 11/2011 | Molinari | F41A 5/28 89/193 |

(Continued)

*Primary Examiner* — Michael D David

(57) ABSTRACT

The invention comprises various minimal modifications to the upper receiver assembly of an AR-platform semiautomatic firearm whereby the firearm is reversibly converted to a pump-action firearm. The modifications comprise a means to introduce a push rod which passes through the front end of the upper receiver and connects a pump hand grip and the bolt carrier group of the firearm. The pump hand grip is guided and supported by the barrel and by a secondary guide rail disposed above the barrel.

6 Claims, 17 Drawing Sheets

(56) References Cited

U.S. PATENT DOCUMENTS

| | | | | |
|---|---|---|---|---|
| 8,176,837 | B1 * | 5/2012 | Jackson | F41A 5/26 89/193 |
| D661,364 | S * | 6/2012 | Kenney | D22/108 |
| 8,250,964 | B2 * | 8/2012 | Stone | F41A 5/26 89/193 |
| 8,640,598 | B1 * | 2/2014 | Jackson | F41A 5/20 89/191.01 |
| 9,261,314 | B1 * | 2/2016 | Jackson | F41A 5/26 |
| 9,347,719 | B1 * | 5/2016 | Stone | F41A 9/41 |
| 2016/0258697 | A1 * | 9/2016 | Hoon | F41A 17/38 |

* cited by examiner

MEANS FOR CONVERTING SEMI-AUTOMATIC FIREARM TO PUMP-ACTION RIFLE

CROSS REFERENCE TO RELATED APPLICATIONS

This application relates to and claims priority under 35 U.S.C. § 119(e) to U.S. Provisional Patent Application No. 62/258,444, titled "Means for Converting Semi-Automatic Firearm to Pump-Action Rifle," which was filed on Nov. 21, 2015 and is hereby incorporated by reference herein in its entirety.

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISC APPENDIX

Not applicable

TECHNICAL FIELD

The invention relates generally to semi-automatic firearms and more specifically to a means for reversibly converting a semi-automatic firearm to a pump actuated non-semi-automatic firearm.

BACKGROUND OF THE INVENTION

Modern Sporting Rifles (MSR) based on the AR-10 and AR-15 platforms, firearms originally designed by Armalite, with calibers ranging from .22 to .308 and larger, are among the most popular firearms sold in the United States today. These AR-platform MSRs, however, have come under increased public scrutiny recently as the result of several high profile shooting incidents. State legislatures in several States, e.g., Connecticut, California and New York, have enacted tough new laws to curb the use of these rifles and reduce the perceived danger to the public. These restrictions have generally focused on the possession and use of high capacity magazines and features associated with achieving high rates of sustained fire. Most restrictions follow the earlier federal statutes and limit the definition of assault rifles to firearms which are (1) semi-automatic, (2) center-fire, and (3) capable of accepting a detachable magazine. At least two rifles have been introduced in recent years which are compatible with the full range of magazines and ammunition useable in these MSRs, and may host some of the same features, but are pump actuated rather than being semi-automatic. One is the Troy Pump-Action AR-15; the other is the Remington 7615. This latter rifle was in the news in 2015 when the US 2nd Circuit Court of Appeals ruled that it is a violation of the 2nd Amendment to the US Constitution for the State of CT to include this rifle on its list of banned firearms.

Herein after, pump action rifles may alternatively be referred to as PAR.

While both of these rifles are excellent weapons, ownership requires purchase of an entirely new rifle and many of the parts used to make them are unique to these designs. For existing owners of AR-15s looking for a less expensive solution to acquiring a PAR, or for prospective owners looking for a rifle which incorporates more standard AR-15 parts than are used in the Remington or Troy models, a solution which allows relatively easy conversion of an existing AR-platform rifle from a semi-automatic rifle to a pump-action version is needed.

BRIEF SUMMARY OF THE INVENTION

Accordingly, it is an object of the present invention to provide a means for converting a semi-automatic AR-platform rifle (including guns ranging in caliber from .22 to .308 caliber or larger firearms) into a pump-action firearm with a minimum of expense and effort by the owner or his/her gunsmith. It is another object of the present invention to make it possible to convert back to a semi-automatic version at the owner's discretion. It is another object of the present invention to create a "kit" of parts that can be conveniently purchased by a consumer and installed without professional help for easy conversion of an existing semi-automatic AR-platform rifle.

For the purpose of this summary and later description, the terms "semi-permanent" mean a configuration or state of assembly that requires special tools and/or disassembly of the action of the firearm and a period of time on the order of approximately 20-30 minutes, or more, usually in a workshop environment where tools and holding fixtures are readily available, to change from one configuration to another.

In some embodiments, the firearm described by this invention comprises a lower receiver assembly and an upper receiver assembly, wherein the low receiver assembly is an unmodified assembly capable of being used on semi-automatic AR-platform rifles and the upper receiver assembly is modified from a standard upper receiver assembly capable of being used on semi-automatic AR-platform rifles only by removal of the hand guard, removal of the gas tube, removal of the gas block, removal of the bolt carrier key, and the addition of a manually operated pump-action reload mechanism. In some embodiments, the pump-action reload mechanism comprises a push rod sized in diameter to slidingly pass through a hole in the front of the upper receiver, a bolt carrier key joined to the push rod, a modified gas block, an aft guide rail support, a pump hand grip connected to the push rod, and a guide rail assembly. In some embodiments, the pump hand grip comprises a generally cylindrical body with a hollow cylindrical cavity disposed parallel to the cylindrical axis of the pump grip body and extending through the full length of the pump hand grip, the hollow cavity is disposed concentrically around the barrel, and the hollow cavity is sized to allow the pump hand grip to slide axially along the barrel. In some embodiments, the guide rail assembly is fixedly attached to the modified gas block on the forward end of the guide rail and to the aft guide rail support on the aft end of the guide rail and engages with the pump hand grip to prevent its rotation around the barrel. In some embodiments, the aft guide rail support is fixedly attached to the barrel.

In some embodiments, the push rod is larger in diameter than a standard gas tube and the upper receiver is additionally modified by enlarging the gas tube hole on the forward end of the upper receiver to slidingly pass the larger diameter push rod.

In some embodiments, the push rod diameter is between 0.21 and 0.4 inches.

In some embodiments, the pump action reload mechanism further comprises a turnbuckle nut that is threaded to accept a fastener with right hand threads on one end and accept a fastener with left hand threads on the other end, wherein the two threaded holes are axially aligned and rotating the turnbuckle nut in one direction about this axis draws the two threaded fasteners closer together and rotating the turnbuckle nut in the other direction moves the two threaded fasteners apart.

In some embodiments, the pump hand grip further comprises a metal rod disposed parallel to the long axis of the pump hand grip and aligned with the push rod and a turnbuckle nut when all are assembled, and wherein the metal rod is embedded and secured into the body of the pump hand grip and threaded on the aft end to engage with one of the left hand or right hand threads of the turnbuckle nut.

In some embodiments, the push rod is threaded on one end and joined to the pump hand grip via a turnbuckle nut.

In some embodiments, the pump hand grip further comprises a set of one or more threaded holes disposed along an upper surface and aligned parallel with the barrel and capable of receiving at least one threaded fastener for joining the pump hand grip and the push rod.

In some embodiments, the push rod has a set of one or more holes that pass transversely through the diameter of the push rod and are sized to allow passage of at least one fastener for joining the push rod to the pump hand grip.

In some embodiments, the firearm further comprises a modified barrel nut.

In some embodiments, a kit of parts is provided to allow an owner to quickly and easily convert a semi-automatic AR-platform rifle to a pump-action rifle. In some embodiments, this kit of parts includes:

a pump hand grip;
a push rod;
a bolt carrier key joined to the push rod;
a means for attaching the push rod to the pump hand grip;
a guide rail;
a modified gas block; and
an aft support.

In some embodiments, the kit further comprises special tooling for enlarging the gas tube hole in the front of the upper receiver.

In some embodiments, the kit further comprises a modified barrel nut.

In some embodiments, the means for attaching the push rod to the pump hand grip comprises a turnbuckle nut.

DETAILED DESCRIPTION OF THE INVENTION

Figure 1:
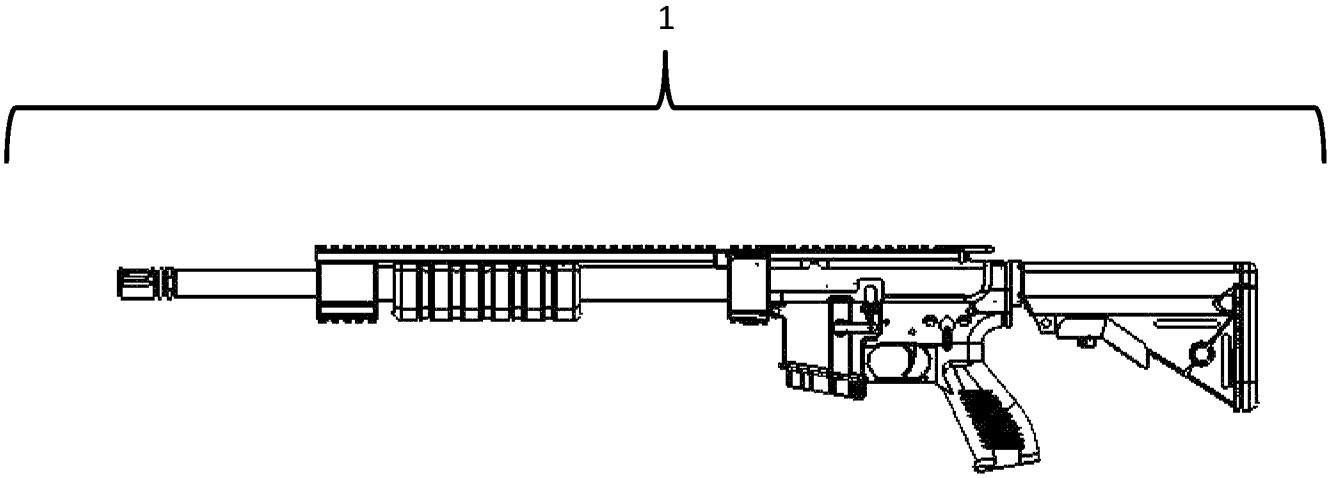
FIG. 1 is a side view of one embodiment of a complete pump-action firearm assembly wherein the pump hand grip is mounted around the barrel and guided by an external rail.

Since the basic AR-platform rifle is of a well-known type, only those parts of the firearm essential to an understanding of the invention will be described in detail. Although the present invention will be described with reference to the exemplary embodiments shown in the drawings, it should be understood that the present invention can be embodied in many alternate forms or embodiments, especially combinations of the parts or embodiments shown. In addition, any suitable size, shape or type of elements or materials could be used.

Figure 2:
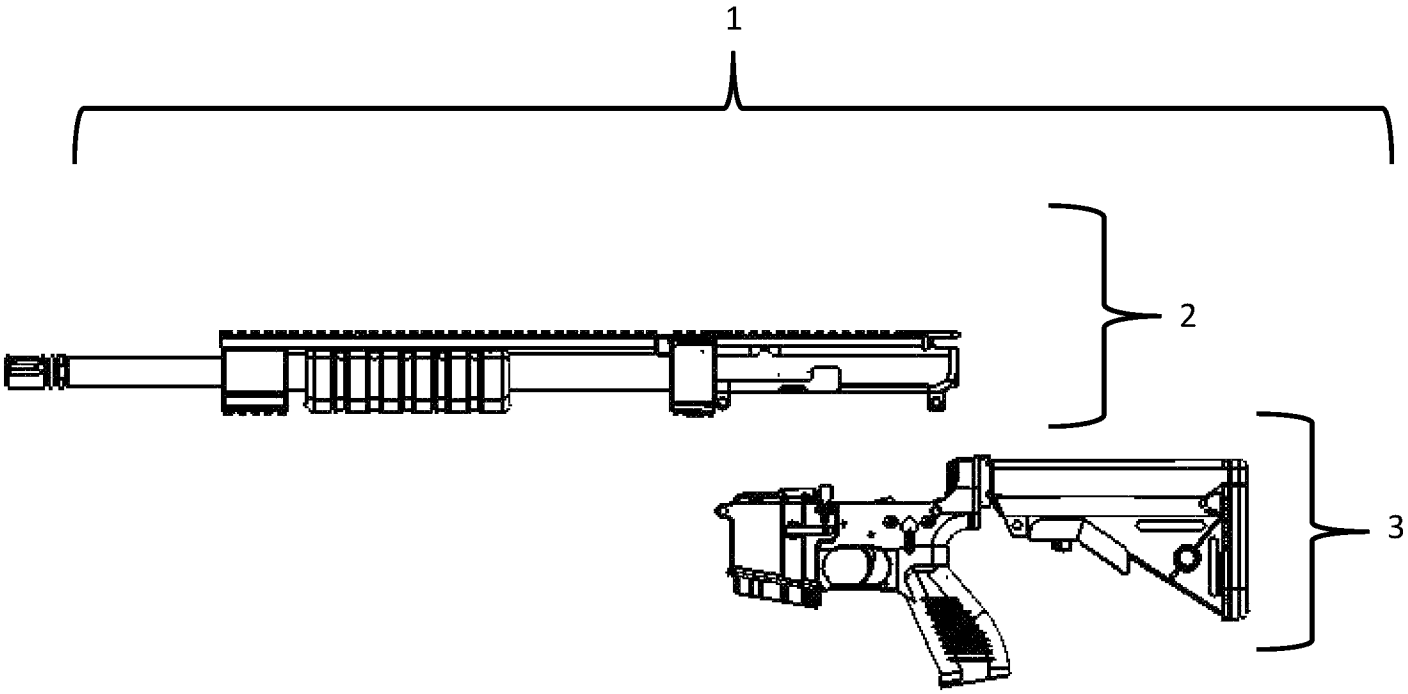
FIG. 2 is an exploded side view of the same firearm shown in FIG. 1, broken down into its two major component groups.

Referring to FIGS. 1-2, one embodiment of a complete pump-action firearm assembly 1 is comprised of an upper receiver assembly 2 (including pump-action reload mechanism components) and a lower receiver assembly 3. The upper and lower assemblies in this design are joined in the same way as a standard AR using forward and rear pivot and takedown pins.

Figure 3:
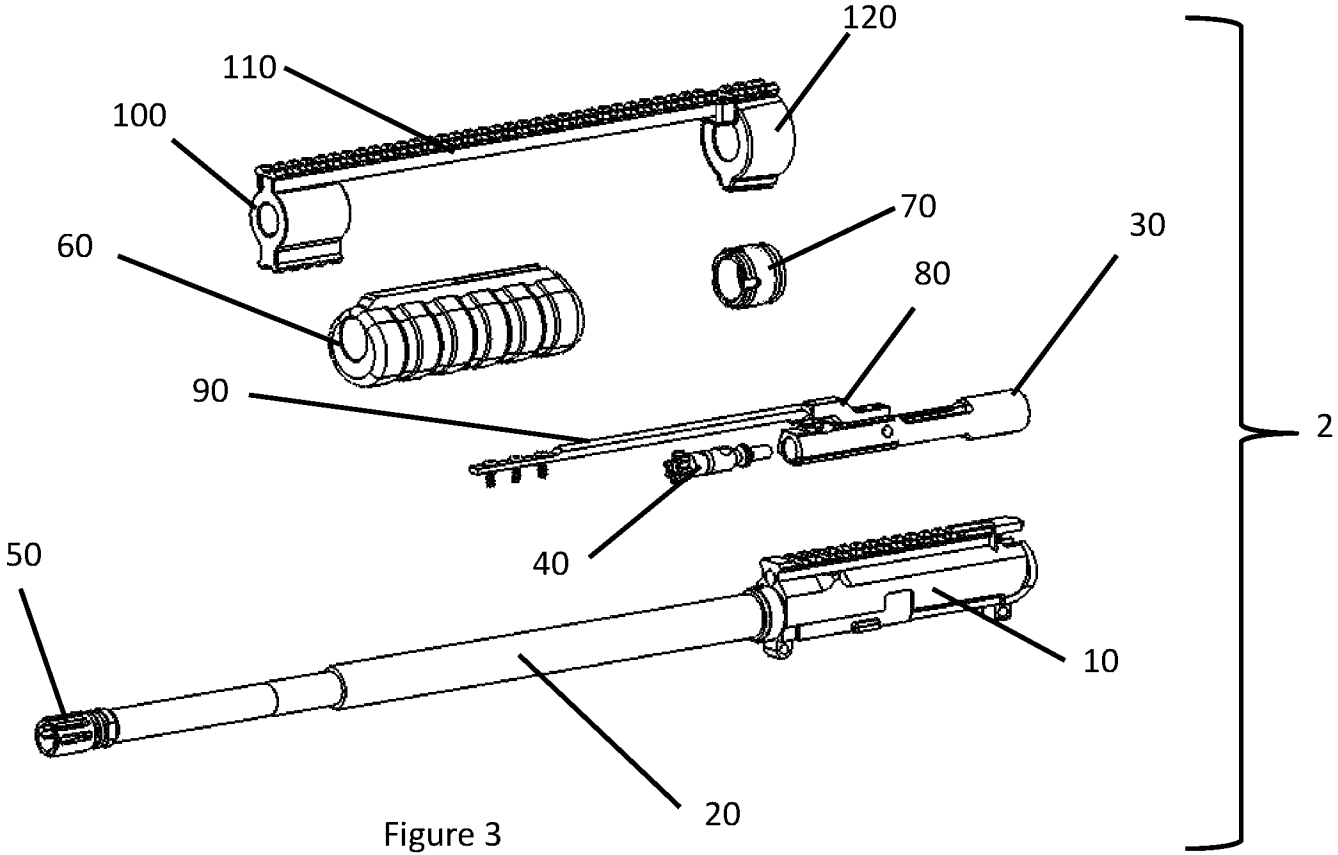
FIG. 3 is an exploded perspective view of the same firearm shown in FIG. 1, but without the lower receiver assembly.

Referring to exploded view FIG. 3, an embodiment is shown of the upper receiver assembly 2 comprising a slightly modified upper receiver 10, a standard barrel 20, a barrel nut 70, a standard bolt carrier 30, a standard bolt 40, and a standard flash suppressor 50. This embodiment also shows various pump-action reload mechanism components including a modified gas block 100, a guide rail 110, a push rod 90, a pump hand grip 60, an aft rail support 120, and a modified bolt carrier key 80. Only those components which are somehow modified from standard AR-15 components are described in the paragraphs which follow.

Referring to FIGS. 4, 5, 6, 7 and 10, in some embodiments, push rod 90 is comprised of an elongated member which connects to the modified bolt carrier key 80 on one end and the pump hand grip 60 on the other. In some embodiments, the connection to the modified bolt carrier key 80 is via a threaded interface 93 on the push rod 90 and threaded hole 84 on the modified bolt carrier key 80. In some embodiments, the connection to the modified bolt carrier key 80 is via a pinned interface between end 93 on the push rod 90 and an un-threaded hole 84 on the modified bolt carrier key 80. In some embodiments, the connection to the modified bolt carrier key 80 is via a clevis fitting on the push rod end 90 and the sides of the modified bolt carrier key 80, or vice versa. In some embodiments push rod end 90 is joined to the modified bolt carrier key 80 via a soldered, brazed, silver soldered, welded or adhesively bonded joint. In some embodiments, the connection to the pump hand grip 60 to the push rod 90 is via a mechanical connection using one or more fasteners that pass through hole(s) 94 in push rod 90 and are secured in hole(s) 65 in pump hand grip 60. In some embodiments, the connection to the pump hand grip 60 is via a snap fit between some molded/formed features incorporated into the slot 66 and mating geometry in push rod 90. In some embodiments, the connection to the pump hand grip 60 is via a clevis fitting on the end of push rod 90 and mating rectangular geometry on the pump hand grip 60 (not shown). In some embodiments, the body of push rod 90 is made from a strong, stiff material such as steel or composite material such as carbon fiber and epoxy. In some embodiments, this push rod 90 is somewhat semi-circular around portions of its cross-section and has a flat surface 92 which allows the push rod to avoid an interference with the barrel nut 70. In some embodiments, this flat surface 92 serves the additional function of preventing rotation of push rod 90 so its connection with bolt carrier key 80 remains secure (e.g., the push rod 90 cannot rotate to disengage the threaded connection) if the connection is a threaded interface. In some embodiments, the diameter of the push rod 90, before the flat surface 92 is created, is approximately ⅜" to give the component greater stiffness and strength to withstand long-term service, but still fit within the available envelope of space between the barrel nut 70 and an internal surface of the upper receiver 10.

Figure 4:
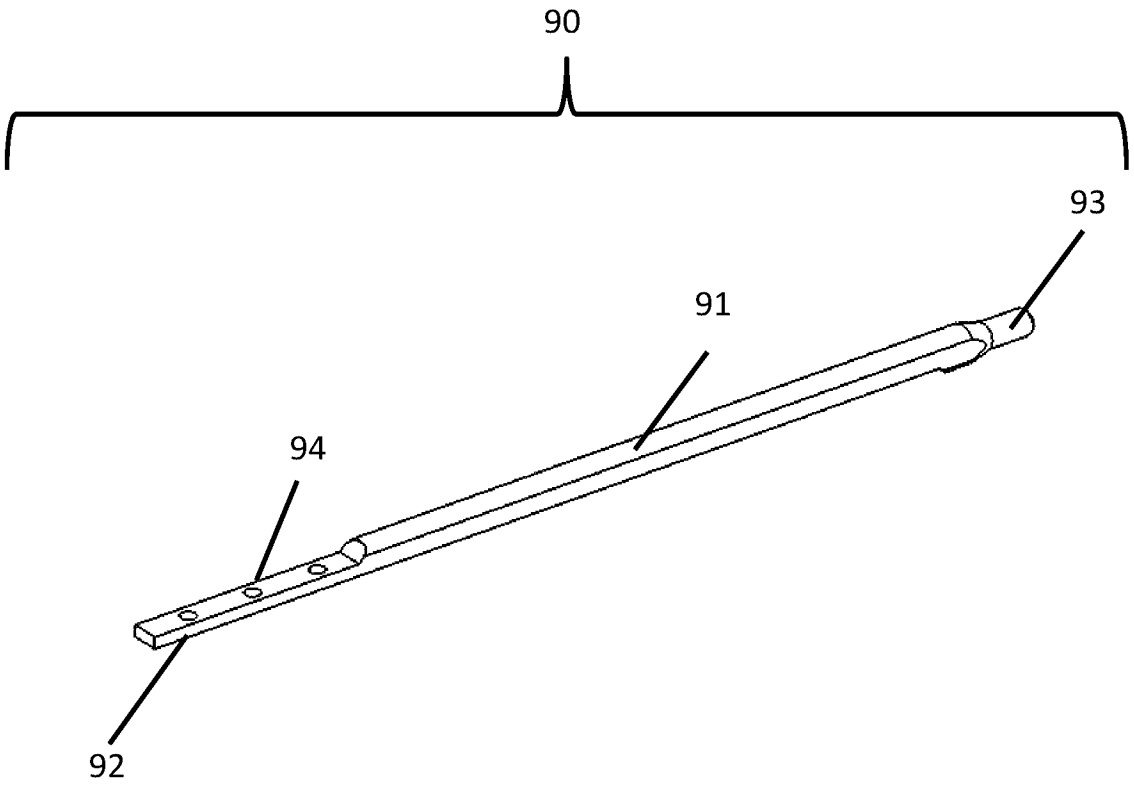
FIG. 4 is a perspective view of one embodiment of a push rod for the firearm shown in FIG. 1.
Figure 5:
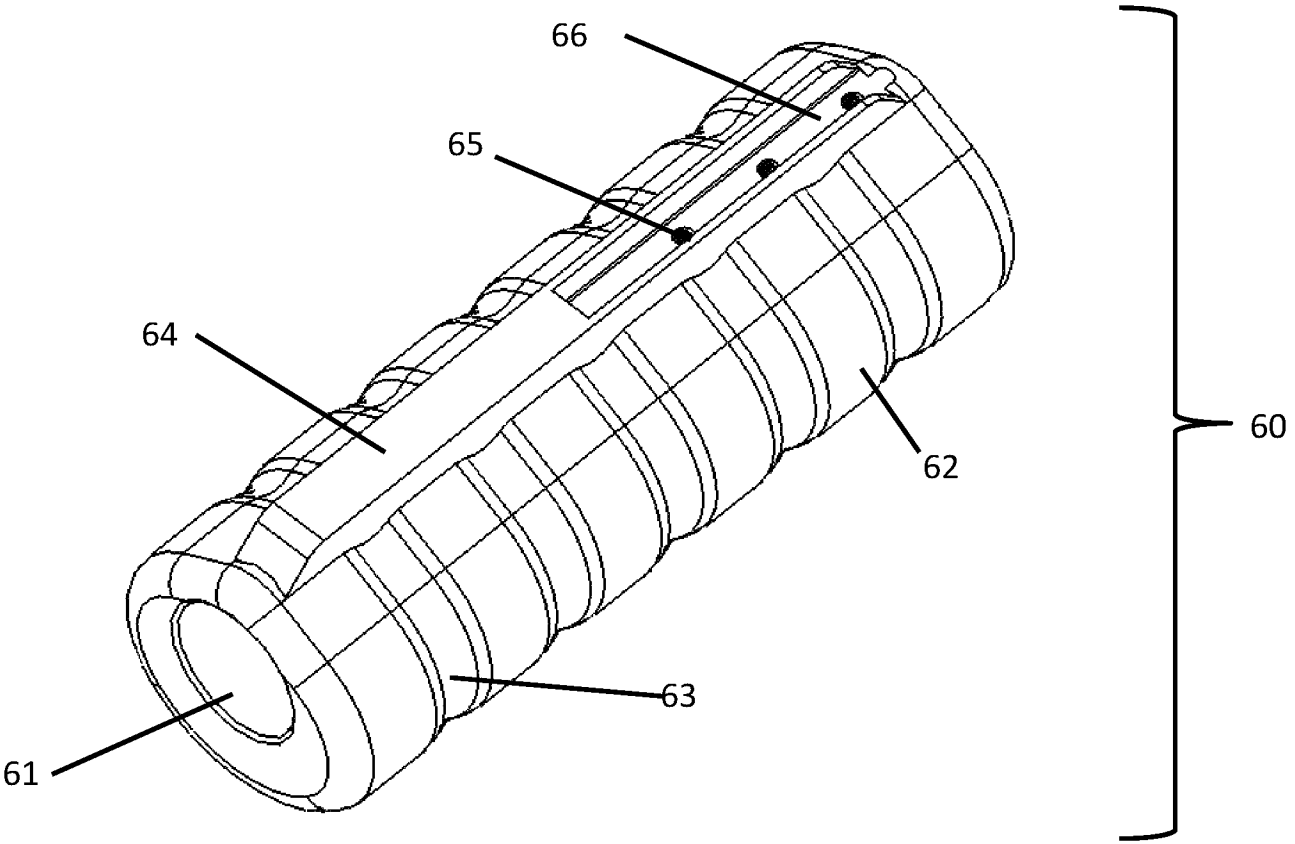
FIG. 5 is a perspective view of one embodiment of a pump hand grip for the firearm shown in FIG. 1.

Referring to FIGS. 4 and 5, in some embodiments, pump hand grip 60 is comprised of a hollow, generally cylindrical shape. It connects with push rod 90 as described above. In some embodiments the inside surface of pump hand grip 60 is smooth and sized to slidingly interface with barrel 20. In some embodiments, the inside surface of pump hand grip 60 comprises a series of lands and grooves (not shown) or splines, which minimize surface contact and may have some self-cleaning properties. In some embodiments, the exterior surface of pump hand grip 60 has texture in the form of grooves 63 or knurling or other geometry to enhance the user's grip and minimize slippage. In operation, the pump hand grip is the user's primary interface with the bolt cycling process as is well understood by someone familiar with pump-action firearms. In some embodiments this pump hand grip 60 may be fabricated using a plastic, even a 3D printed plastic. In other embodiments, the handgrip 60 may be fabricated from wood, a composite material, a molding compound, or metal.

Figure 6:
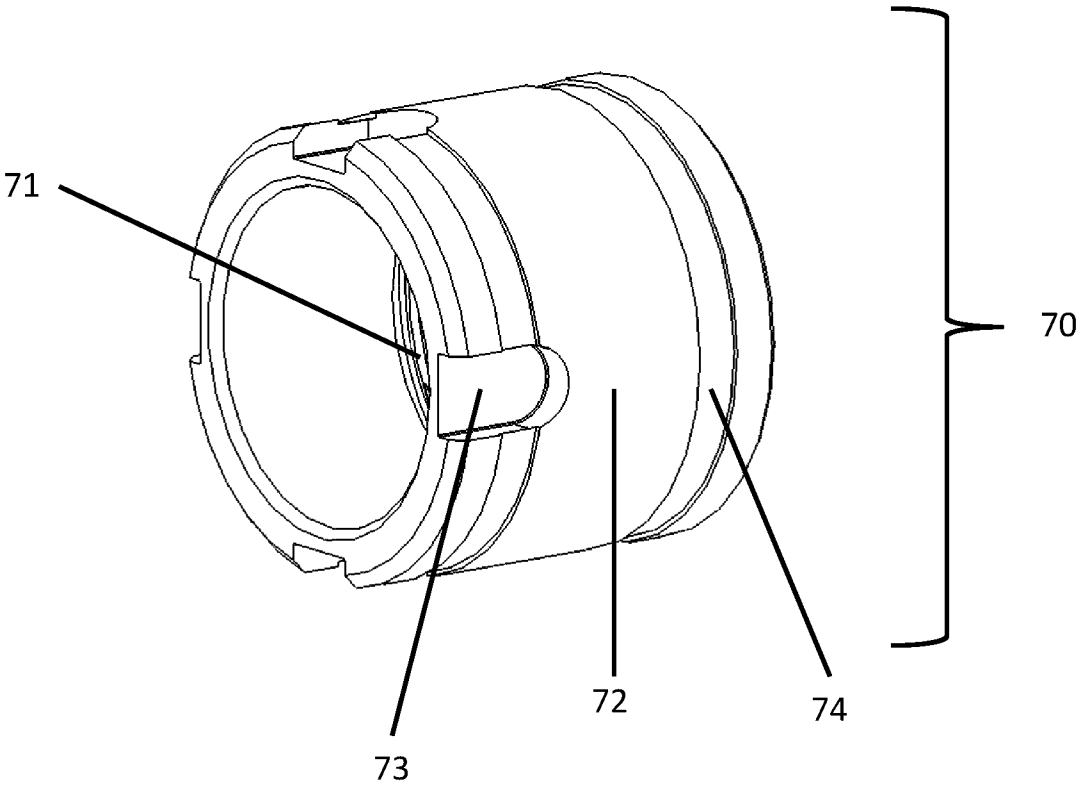
FIG. 6 is a perspective view of one embodiment of a modified barrel nut for the firearm shown in FIG. 1.
Figure 7:
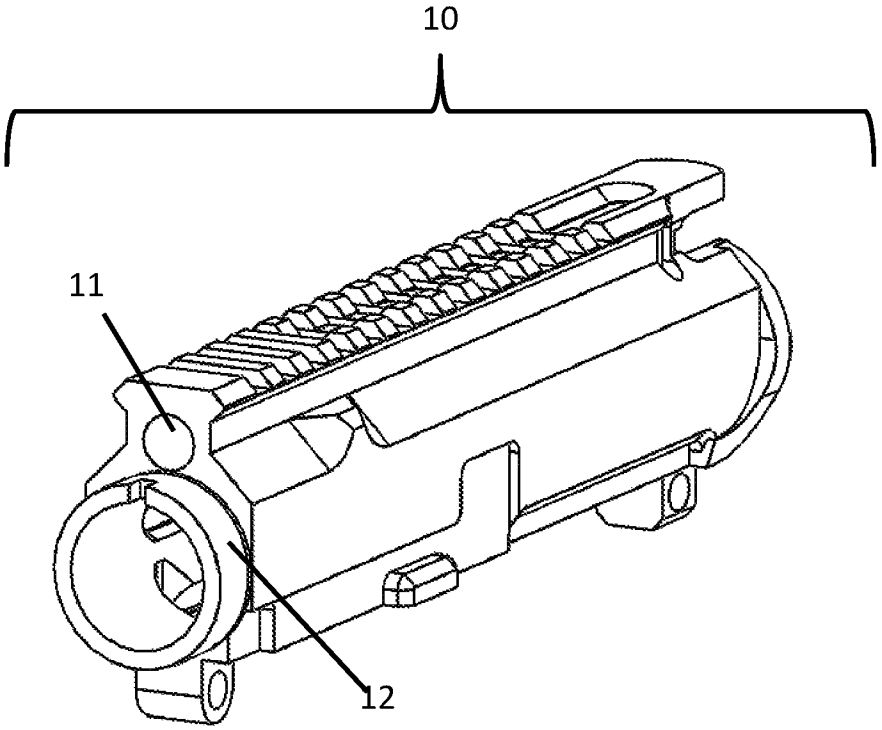
FIG. 7 is a perspective view of one embodiment of a modified upper receiver of the firearm shown in FIG. 1.
Figure 12:
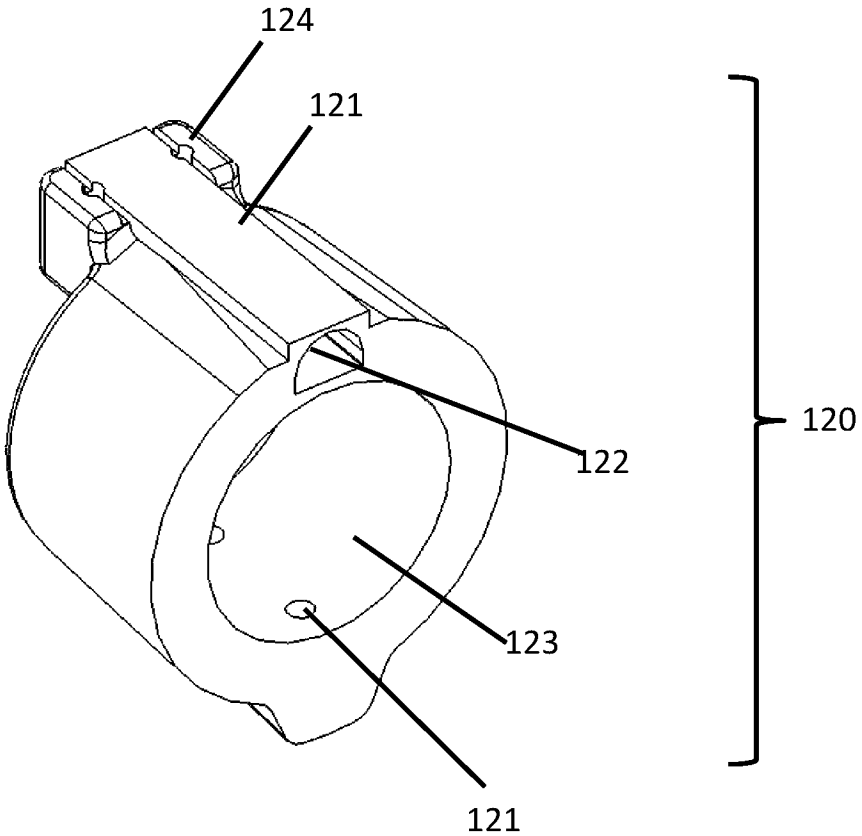
FIG. 12 is a perspective view of one embodiment of the aft guide rail support for the rail used to guide the pump hand grip as it travels along the barrel for the firearm shown in FIG. 1.

Referring to FIGS. 6, 7 and 12, in some embodiments, a barrel nut 70 is comprised of a hollow, generally cylindrical shape. In some embodiments, it screws onto the threads 12 of upper receiver 10 and locks the barrel 20 to the upper receiver 10. In some embodiments, the outer cylindrical surface 72 slidingly supports the aft rail support 120. In some embodiments, grooves 74 allow set screws in the aft rail support 120 to bear on the outer surface, locking the two components together, without marring portions of surface 72 that would otherwise interfere with it being installed or removed. In some embodiments, slot 73 may be used with a spanner wrench to torque threads 71 onto the upper receiver 10. In some embodiments barrel nut 70 is made from high strength steel such as 4140 that has been appropriately heat treated for added strength. In other embodiments it may be made of aluminum for lighter weight.

Figure 8:
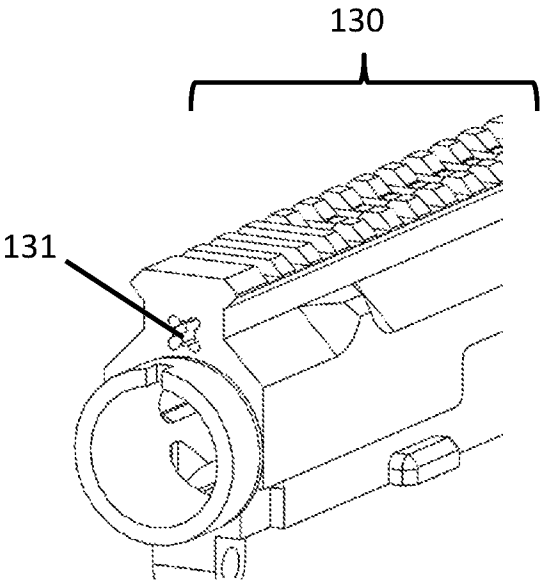
FIG. 8 is a perspective view of the forward end of a standard upper receiver for comparison with the firearm shown in FIG. 7.

Referring to FIGS. 7 and 8, in some embodiments standard upper receiver 130 may be modified by enlarging hole 131 to a size which can accommodate a push rod 90 which is larger in diameter than a standard gas tube common on AR-platform rifles. Such a larger diameter hole 11 is illustrative of some embodiments. It is understood that the general function of this pump-action rifle could be achieved with a smaller diameter push rod capable of passing through standard hole 131.

Figure 9:
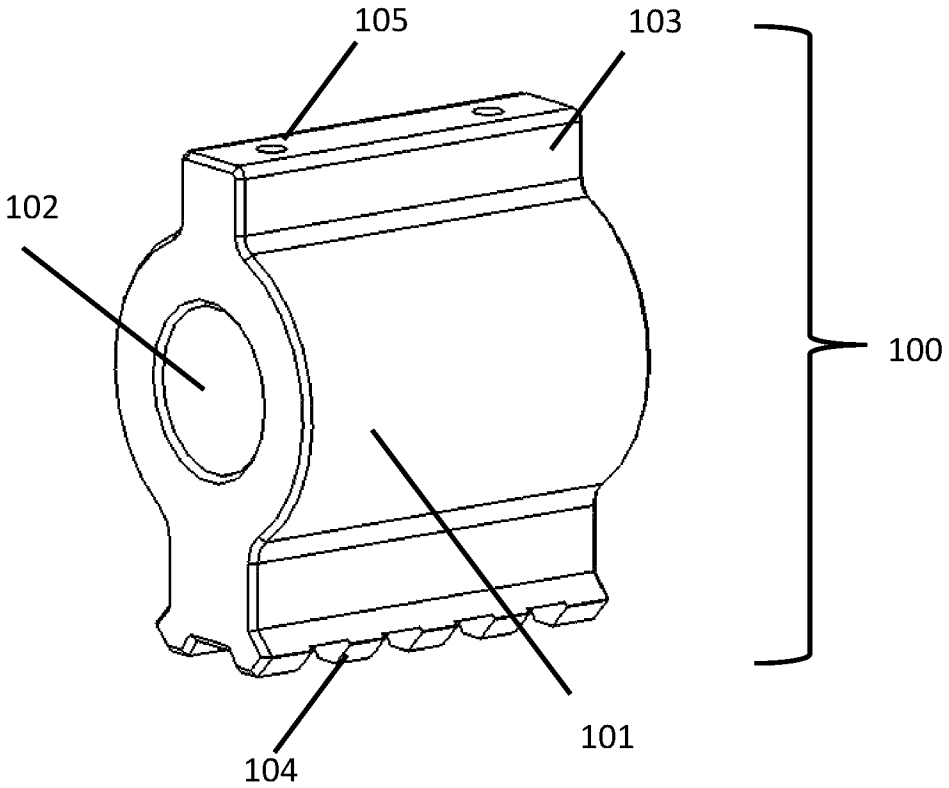
FIG. 9 is a perspective view of one embodiment of a modified gas block that serves as the forward support for the rail used to guide the pump hand grip as it travels along the barrel for the firearm shown in FIG. 1.
Figure 11:
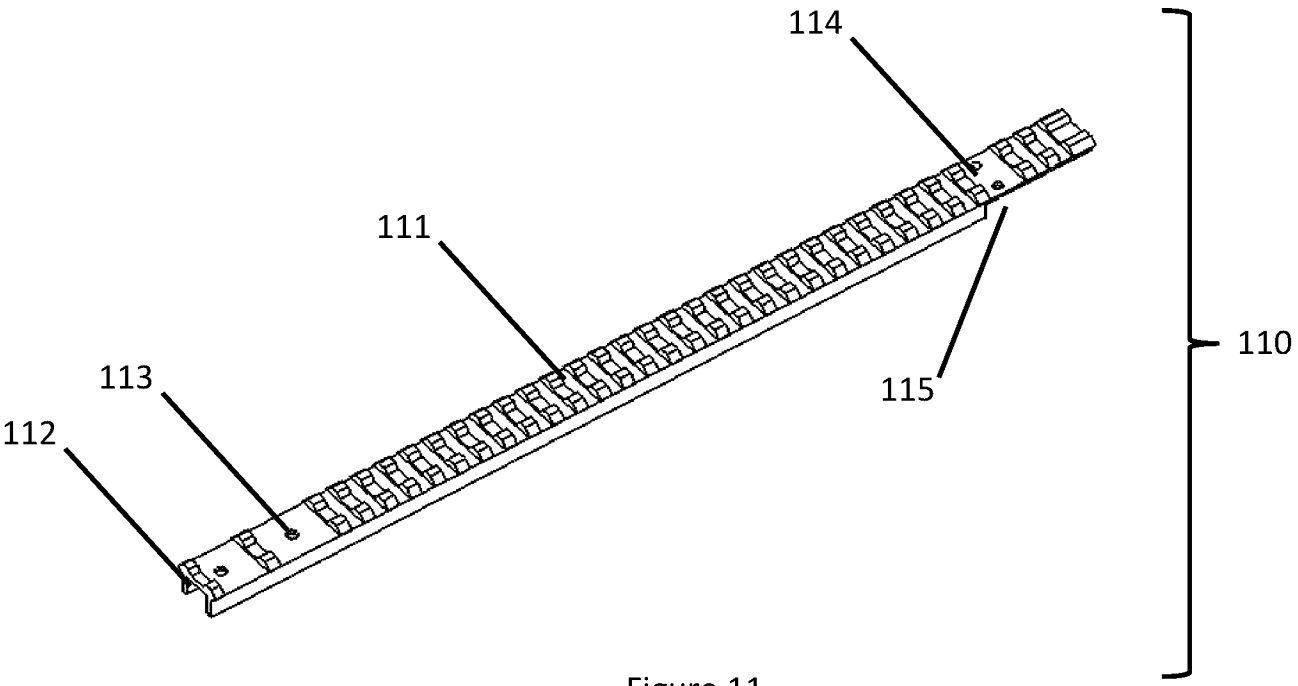
FIG. 11 is a perspective view of one embodiment of a rail that is positioned external and parallel to the barrel and is used to guide the pump hand grip as it travels along the barrel for the firearm shown in FIG. 1.

Referring to FIGS. 9 and 11, the modified gas block 100 is intended to slidingly engage with the barrel 20 using hole 102 and support guide rail 110. This component may also serve to cover the gas port in most AR barrels and, as modified, prevents the escape of virtually all the gas that would otherwise escape and be used, in the normal AR configuration, to cycle the bolt through direct gas impingement or indirectly through a gas-operated piston. These components are not illustrated, but would be well known to someone skilled in the art. This modified gas block 100 may optionally include a Picatinny rail profile 104 on the bottom (as shown) or on the sides (not shown) or both locations. In some embodiments holes through the bottom or sides may be used to threadingly engage one or more set screws to better secure modified gas block 100 to barrel 20. In some embodiments, threaded holes 105 may be used to secure guide rail 110 to the generally prismatic section 103.

Figure 10:
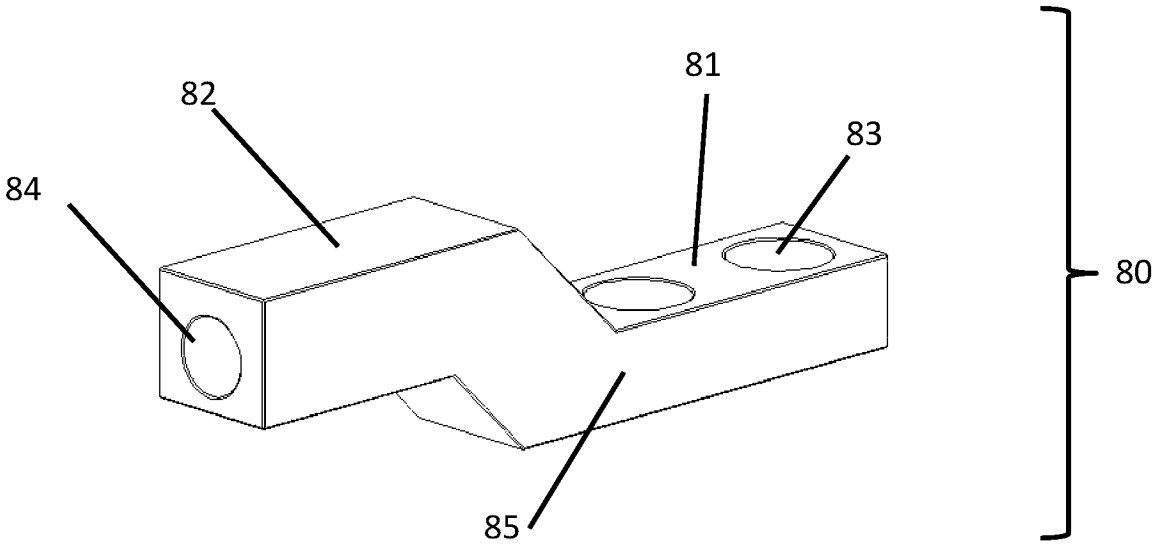
FIG. 10 is a perspective view of one embodiment of a modified bolt carrier key for the firearm shown in FIG. 1.

Referring to FIG. 10, in some embodiments, bolt carrier key 80 is a modification of the standard bolt carrier key. In some embodiments these modifications comprise one or more of a larger hole 84 to threadingly attach to end 93 of push rod 90, an increase in the dimension between surfaces 81 and 82 which is possible because the charging handle (not shown) is no longer required as a system component, and a movement of wall 85 (and its mirror opposite wall) outboard from the centerline of the bolt carrier key 80 to increase strength and simplify manufacturing. This latter change, if included in some embodiments, will necessitate removal of the bolt carrier key to enable removal of the cam pin (not shown) during disassembly of bolt carrier 30.

Referring to FIGS. 5, 9, 11 and 12, a slot on the bottom of guide rail 110 captures rectangular protrusion 64 on the pump hand grip 60 and guides its travel linearly along the barrel 20 for approximately 4" when pump hand grip 60 is used to cycle bolt carrier 30 and bolt 40. In some embodiments, guide rail 110 incorporates a modified Picatinny rail section 111 on the top surface with two parallel "legs" 112 protruding perpendicular to the upper surface. In other embodiments, a single leg located along the centerline of the guide rail section 110 could also be effective in guiding the pump hand grip 60. In this latter embodiment, the single leg on guide rail 110 would slidingly engage a slot in the top of pump hand grip 60. In some embodiments holes 113 may be used in conjunction with screws (not shown) to secure guide rail 110 to the modified gas block 100. In some embodiments, holes 114 may be used in conjunction with screws (not shown) to secure guide rail 110 to the aft rail support 120. In some embodiments, the modified gas block, guide rail and aft rail support may be joined via adhesive bonding (with or without screws or other fasteners), welded together, or made from one monolithic component. In some embodiments relief 115 eliminates possible interference between rail 110 and the aft rail support 120.

Referring to FIGS. 4, 6 and 12, aft rail support 120 comprises a body which slidingly engages with the barrel nut 70 via hole 123. Hole 122 allows passage of the push rod 90. Section 121 is the primary mounting surface for guide rail 110 and holes 124, which are threaded in some embodiments, may be used in conjunction with screws (not shown) to secure guide rail 110 in place. (Alternate attachment means have been described above.) Holes 121 may be used in conjunction with set screws (not shown) to secure the aft rail support 120 to barrel nut 70.

Figure 13:
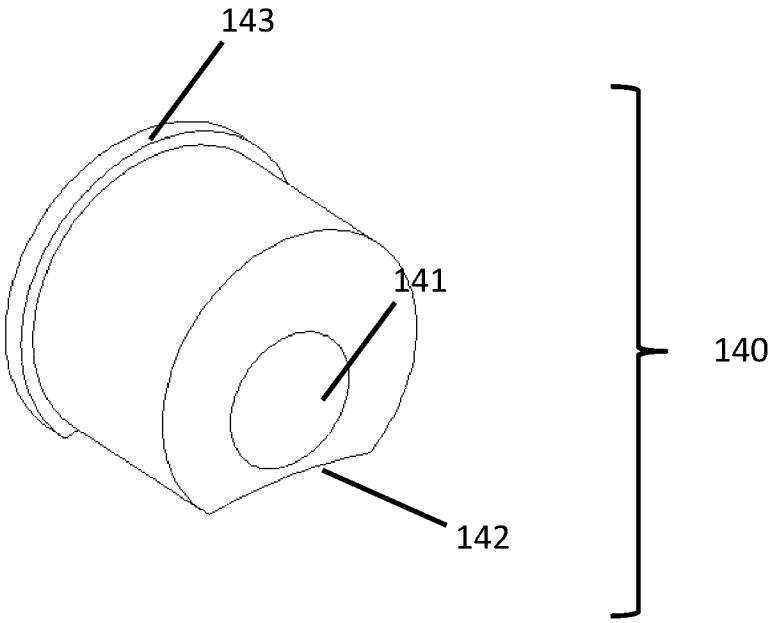
FIG. 13 is a perspective view of one embodiment of a restoration insert that could be used to restore the lower receiver of the firearm shown in FIG. 1 to its original functionality.

Referring to FIGS. 7, 8 and 13, restoration insert 140 is not a part of the pump-action rifle, but is illustrated as an embodiment of one means to restore hole 11 in modified upper receiver 10 to a condition functionally equivalent to hole 131 in standard upper receiver 130. In some embodiments for an AR-15, hole 141 is offset downward from the center of curvature for surface 140 by approximately 0.032" so as to properly align with standard gas tube positioning and the unmodified height of the gas port in an unmodified bolt carrier key. This dimension may vary for other embodiments or for other calibers, e.g., a .308 caliber rifle. The relief provided by concave surface 142 is intended to avoid interference with the barrel nut 70.

Conversion of a standard AR-15 rifle into a pump action rifle in accordance with the previous embodiments would generally include the following steps:

- Disassemble the upper receiver assembly including removal of the charging handle, the existing bolt carrier key from the bolt carrier, barrel nut, hand guard, flash suppressor, gas tube, and gas block. It is not required to remove the forward assist mechanism in a standard AR-platform upper receiver assembly. Any components not reused in the following steps should be stored, if possible and legal, for restoration of the original configuration in the future, if desired.
- Enlarge hole 131 in the existing upper receiver to the size and position shown for hole 11 in the modified upper receiver 10. This may be accomplished by a qualified machinist or gunsmith, or by the owner using an appropriate drill guide. Alternatively, a new upper receiver can be purchased with this geometry already embodied in the part.
- Mount the modified bolt carrier key 80 to the bolt carrier 30. Note: the bolt 40 and all other hardware comprising the bolt carrier group should already be installed before modified bolt carrier key 80 is attached. For reference, since it is not mentioned above, the bolt carrier group comprises the bolt carrier 30, the bolt 40, the bolt carrier key 80, and several other components such as a firing pin, cam pin and miscellaneous fasteners.
- Screw the threaded end of the push rod 90 into the modified bolt carrier key 80 using threaded interfaces 93 and 84. Set aside until final assembly.
- Install the existing barrel 20 back into the modified upper receiver 10. Secure the barrel in place with the slotted barrel nut 70. Use a spanner wrench to engage the slots to torque the barrel nut to the specified torque.
- Mount aft rail support 120 over barrel nut 70 and secure using the set screws in the bottom of aft rail support 120.
- Slide the pump hand grip 60 over barrel 20. The attachment holes 65 and extension 64 should be facing up.
- Slide modified gas block 100 over barrel 20 and secure in place using the set screws in the bottom of modified gas block 100.
- Install the bolt carrier 30, with attached push rod 90, modified bolt carrier key 80, and standard bolt 40 into the upper receiver 10. It is not necessary (or possible) to reinstall the charging handle since the width of the modified bolt carrier key 80 fills the full channel normally occupied by the charging handle. During installation, carefully guide the push rod through hole 11 in the front end of receiver 10. Use provided screws to attach the forward end of push rod 90 to pump hand grip 60.
- Mount guide rail 110 using provided screws to secure it to the modified gas block and aft rail supports, 100 and 120 respectively.
- Reattach flash suppressor 50 to the end of barrel 20.
- Reattach the lower receiver and verify that the bolt carrier cycles properly. Dry fire the weapon to ensure the remainder of the firing mechanism still works properly. Note: do not remove the buffer or buffer spring from the lower receiver assembly. These components are used to keep the bolt and bolt carrier in battery without the need for some secondary system.
- Attach any other components such as optics.
- Test fire.

Figure 14:
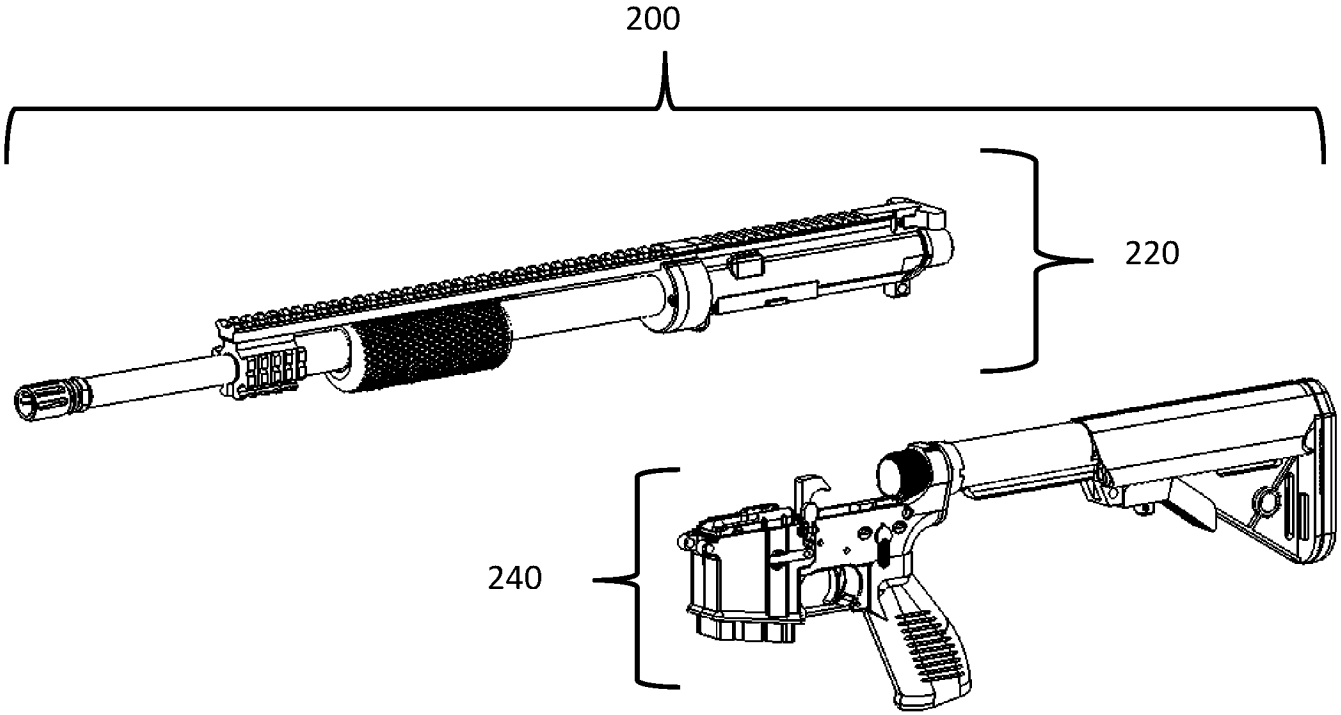
FIG. 14 is a perspective exploded view of an alternative embodiment of a pump action rifle showing the two major subassemblies.
Figure 15:
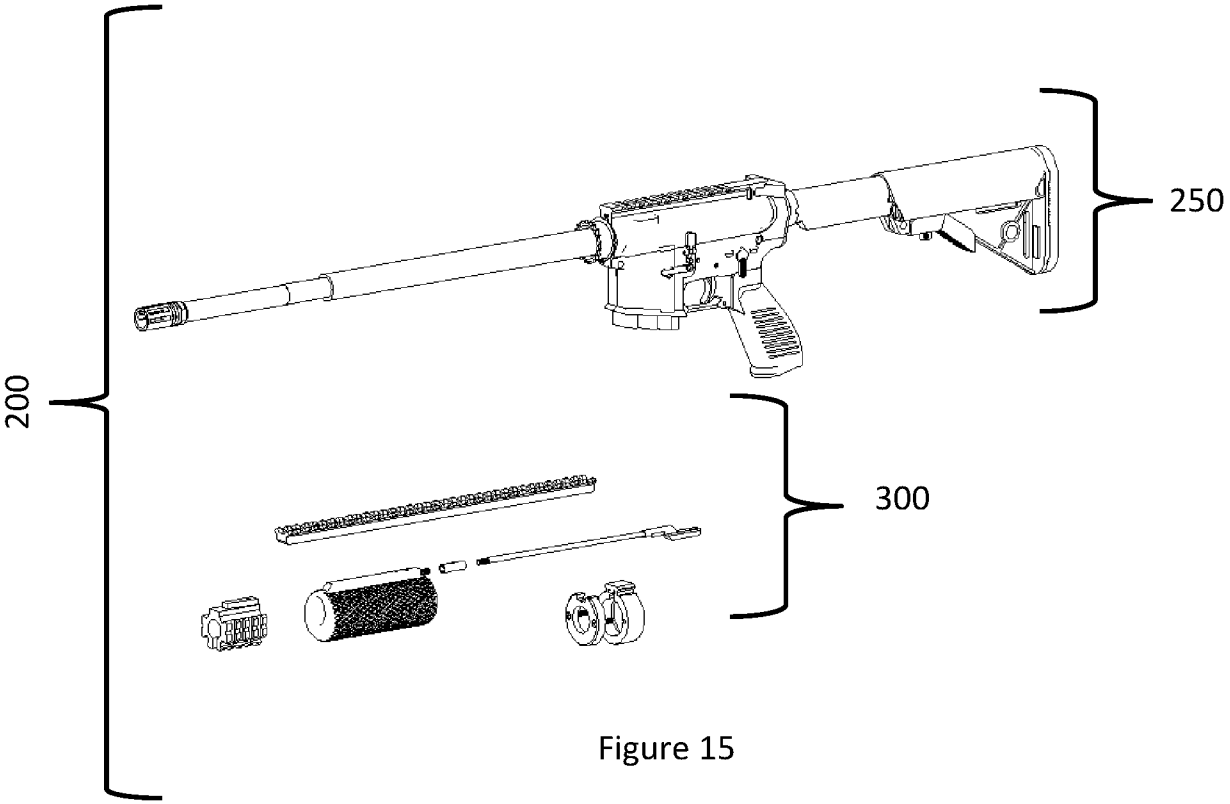
FIG. 15 is a perspective exploded view of an alternative embodiment of a pump action rifle showing the components supplied by the owner and those supplied in a pump action rifle conversion kit.

FIG. 14 illustrates an alternative embodiment of a pump action rifle 200 broken into its two major subassemblies, an upper receive assembly 220 and a lower receiver assembly 240. Though somewhat different in the details as compared to those described above, this embodiment incorporates the same key functionality as previously described, namely:

- Use of otherwise unmodified upper and lower receiver assemblies as the base
- A pump hand grip that is concentric to and slides along the barrel
- A guide rail for the pump hand grip Some differences in this family of embodiments that will be explained in greater detail below include:

- Use of a smaller diameter push rod eliminating the need for any modifications to the upper receiver
- Use of a standard barrel nut
- Use of a standard bolt carrier key and maintaining the use of the charging handle for both functional and cosmetic reasons
- Use of a turnbuckle nut to join the pump hand grip and push rod FIG. 15 illustrates a different division of the components of an embodiment of a pump action rifle 200. Group 250 consists of the parts intended to be supplied by the person making the conversion while group 300 consists of parts to be supplied as part of a pump action conversion kit. It is understood, however, that while one sales approach for future products based on this invention could follow this conversion kit model, it is also possible and perhaps preferable for complete rifles embodying these pump action components to be sold to buyers.

Figure 16:
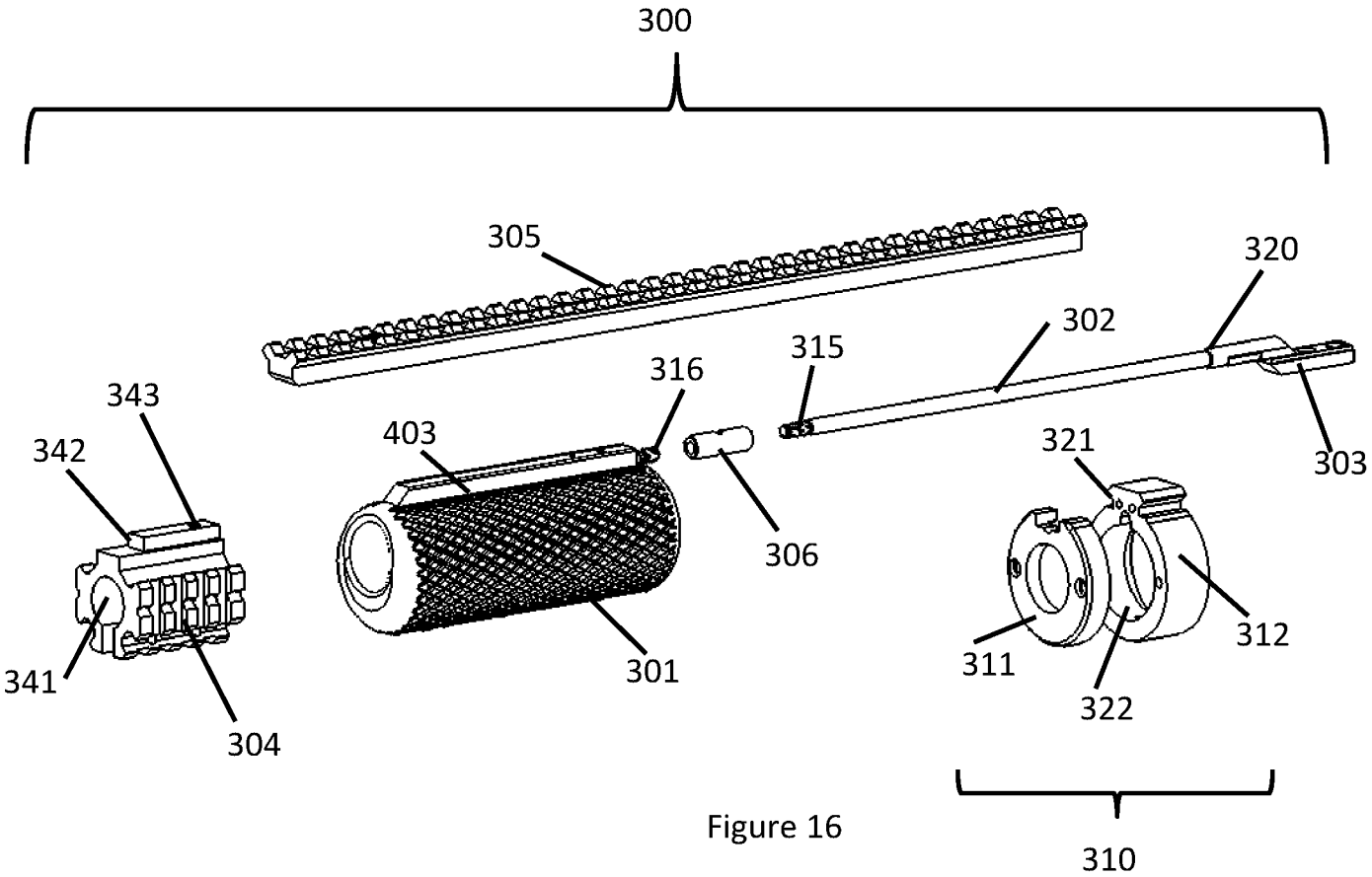
FIG. 16 is a perspective exploded view of one embodiment of the components supplied in a pump action rifle conversion kit.

FIG. 16 illustrates in greater detail the components of some embodiments that comprise a kit of parts 300 that could be used to convert a standard AR-platform rifle to a pump action rifle. Alternatively, as just noted, these are also illustrative of the components that could be installed at the factory as part of a ready-made pump action rifle variant of the AR-platform rifle in lieu of the components routinely used for making a standard gas-operated semi-automatic AR firearm. In some embodiments, these components include: a pump hand grip 301; push rod 302; standard bolt carrier key 303 which is permanently joined to push rod 302; modified gas block 304; guide rail 305; turnbuckle nut 306; and aft guide rail support 310. Subcomponents of aft guide rail support 310 noted within this figure include: support body 312 and support cover 311. Various details of note within the various components of some embodiments include:

- a threaded end 315 of push rod 302 intended to engage one end of turnbuckle nut 306;
- a threaded end 316 of a metal rod (shown in more detail in FIG. 17 and described below) which is embedded into pump hand grip 301 and intended to engage a second end of turnbuckle nut 306;
- attachment joint 320 between bolt carrier key 303 and push rod 302 that could be a threaded joint, a brazed joint, a silver soldered joint, a welded joint, an adhesively bonded joint, or other and could either be a butt joint or a shear joint wherein one end of push rod 302 is sized to slip into the existing hole on the end of standard bolt carrier key 303 before whatever joining technique is applied;
- an inner surface 322 of support body 312 which is intended to slidingly fit over a standard barrel nut (not shown) and be secured to the standard barrel nut using a locking set screw (not shown) and an internal retaining ring (not shown);
- holes 321 in support body 312 that can be used with spring pins (not shown) to align and support the guide rail 305 (using matching holes in the aft end of guide rail 305, not shown);
- bore 341 in modified gas block 304 which slidingly fits over the gas block section of barrel 20;
- rectangular block 342 protruding from the top of modified gas block 304 which slidingly fits into a matching recess (not shown) in the forward end of guide rail 305;
- threaded hole 343 in modified gas block 304 which accepts a threaded fastener (not shown) to join and hold guide rail 305 to modified gas block 304;
- rectangular protrusion 403 on the top of pump hand grip 301 which is intended to slidingly engage a matching slot in the bottom of guide rail 305 (not shown) wherein the slot is long enough and positioned so pump hand grip 301 can easily slide axially along barrel 20 for approximately 4 inches, but without rotation around barrel 20, when the bolt carrier group (not shown) is to be manually cycled for reloading the rifle.

It is understood the figures shown are illustrations of one embodiment and that variations of these details, for example those cited above for FIGS. 1-13 with slight modifications, could be incorporated into other embodiments and could be equally effective in connecting the pump hand grip 301 to the push rod 302 and the modified bolt carrier key 303 such that pump hand grip 301 slides concentrically along the barrel 20, is guided axially by the barrel 20, and is prevented from rotation by guide rail 305 such that the action of the firearm can be easily and effectively manually cycled.

Figure 17:
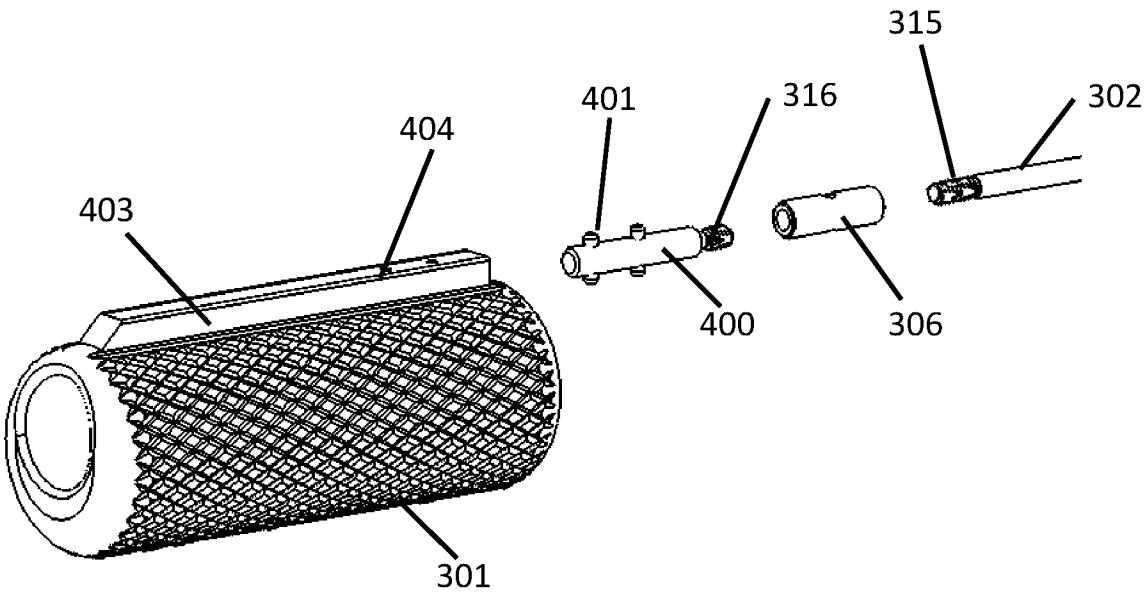
FIG. 17 is a perspective exploded view of one embodiment of a method for joining the pump hand grip and the push rod.

FIG. 17 is an exploded view of the connection mechanism between pump hand grip 301 and push rod 302. In this figure the embedded metal rod 400 is shown in an exploded view. In some embodiments metal rod 400 is embedded in a cylindrical cavity (not shown) in the raised rectangular portion 403 of pump hand grip 301. In some embodiments rod 400 is secured into the cavity with an adhesive. In some embodiments, it is secured in the cavity with spring pins 401 that matingly engage with holes 404 in protrusion 403. In some embodiments both an adhesive and spring pins are used. In some embodiments, wherein pump hand grip 301 is metallic, the joint between rod 400 and protrusion 403 is welded or brazed. As noted above, thread 316 may be either left hand or right hand threads and thread 315 is the opposite of thread 316, i.e., one is left hand and the other is right hand. Correspondingly, the matching ends of turnbuckle nut 306 have mating threads to join with threaded ends 315 and 316 such that when turnbuckle nut 306 is turned in one direction, threaded ends 315 and 316 are drawn together and when turnbuckle nut 306 is turned in the other direction, threaded ends 315 and 316 are forced apart. Also, as noted above, protrusion 403 of pump hand grip 301 is intended to slide within a matching groove in the bottom of guide rail 305 (FIG. 16) such that pump hand grip 301 is prevented from rotating about the barrel.

Conversion of a standard AR-15 rifle into a pump action rifle in accordance with the embodiments illustrated using FIGS. 14-17 would include the following instructions:

- Disassemble the upper receiver assembly including removal of the charging handle, the existing bolt carrier key from the bolt carrier, barrel nut, hand guard, flash suppressor, gas tube, and gas block. It is not required to remove the forward assist mechanism in a standard AR-platform upper receiver assembly. Any components not reused in the following steps should be stored, if possible and legal, for restoration of the original configuration in the future, if desired.
- Mount the subassembly of bolt carrier key 330 and push rod 302 to the bolt carrier 30 and set them aside temporarily.
- Install the support body 312 around the standard barrel nut and secure them together with the retaining ring that normally is a part of the barrel nut. Install this subassembly onto the existing barrel 20 and use it to mount the barrel to the upper receiver 130, taking care that the support body 312 and the retaining ring will be properly aligned with the upper receiver once the barrel nut is fully torqued so the push rod will freely pass. This may require pre-fitting the barrel nut to the barrel and upper receiver and noting the orientation of the barrel nut when it is fully tightened and then aligning the retaining ring before the subassembly is installed. Torque the barrel nut to the specified torque.
- Mount support cover 311 over barrel 20 and secure it to the support body 312 using screws supplied in the kit.
- Slide the pump hand grip 301 over barrel 20. The protrusion 403 should be facing up.
- Slide modified gas block 304 over barrel 20 and secure in place using the set screws in the bottom of modified gas block 304.
- Install the bolt carrier 30, with attached push rod 302, bolt carrier key 303, and standard bolt 40 into the upper receiver 130. (Include the charging handle as it is required with a standard bolt carrier key to properly align the bolt carrier group inside the upper receiver.) During installation, carefully guide the push rod through hole 131 in the front end of receiver 130. Use the turnbuckle nut 306 to attach push rod 302 to pump hand grip 301 (via protruding threaded end 316).
- Mount guide rail 305 using provided screw on the forward end and spring pins on the aft end to secure it to the modified gas block and aft supports, 304 and 310 respectively.
- Reattach flash suppressor 50 to the end of barrel 20.
- Reattach the lower receiver and verify that the bolt carrier cycles properly. Dry fire the weapon to ensure the remainder of the firing mechanism still works properly.

Note: do not remove the buffer or buffer spring from the lower receiver assembly. These components are used to keep the bolt and bolt carrier in battery without the need for some secondary system.

Attach any other components such as optics.

Test fire.

As noted above, one existing variant of a pump-action rifle generally compatible with the AR-platform MSRs has been developed and patent applied for by Sergey Monveldt et. al. and assigned to Troy Industries. Specifically, the Troy design is described in US Patent Application US2015/0113848 A1 dated Apr. 30, 2015 (related to a provisional application, 61/897,170 filed Oct. 29, 2013.) The Troy design is a stand-alone version of the AR-platform that does not allow retrofitting an existing standard AR rifle with the addition of several components as is the case with the present invention. Additionally, the Troy design comprises "a handguard disposed around the barrel," and a "fore-end body," both of which are not part of the rifle described above. To be more specific, the Troy design utilizes the hand guard and fore-end body as the means to support and guide the pump hand grip whereas the design described herein utilizes the barrel itself to support the pump hand grip and a guide rail, which is neither functionally nor aesthetically similar to a hand guard, to guide the pump hand grip.

As further noted above, it is an object of the present invention to provide a means for conversion of a semi-automatic AR-15 platform rifle (including similar guns in a larger caliber than .226, e.g., a .308 caliber firearm) into a pump-action firearm. It is another object of the present invention to make it possible to convert back to a semi-automatic version of the firearm at the owner's discretion. It is another object of the present invention to create a "kit" of parts that can be conveniently purchased by a consumer for easy conversion of an existing semi-automatic AR-platform rifle in his/her own home or shop. To achieve this latter objective, in some embodiments a kit may include one or more of the necessary parts and tools or variations of these parts or tools. Considering, for example, the embodiment shown in FIG. 1, these parts might include pump hand grip 60, modified gas block 100, guide rail 110, aft rail support 120, push rod 90, barrel nut 70, modified bolt carrier key 80, a spanner wrench for tightening barrel nut 70, and a drill bushing guide for modifying upper receiver version 130 into upper receiver version 10.

In use, the operator moves the pump hand grip 60 or 301 to the rear to cycle the bolt carrier 30. If a shell is in the barrel chamber, this action should extract the shell. Once the bolt carrier reaches the rear end of its travel, the pump hand grip can be cycled forward with assist from the buffer spring, loading a shell from the magazine and making the weapon ready to fire. Once the bolt is in battery, the buffer spring integral to all standard AR-platform rifles keeps it in place just as it does for the semi-automatic version of these firearms. This pump-action AR-platform rifle modification does not require any changes to the lower receiver, so trigger pull, functioning of the safety, loading/unloading magazines, etc., all remain unchanged from normal operations.

One requirement, not mentioned previously, is that the barrel outside diameter must be constant from the aft end of the gas block engagement section to the receiver section so the pump hand grip can be installed and fully supported over the length of travel of the pump hand grip. For AR-15 firearms, this requirement is easily satisfied by the rifle-length Heavy Barrel (HBAR) format—terms which will be immediately understood by someone skilled in the use of these firearms.

If an oversized push rod has been used, then to return the pump-action rifle to semi-automatic operation, the kit products are removed, restoration insert 140 is added to reduce the hole size and properly align the centerline for the gas tube pass-thru, and all original hardware is reinstalled.

The invention claimed is:

1. A kit of parts for converting a semiautomatic AR-platform rifle having an upper receiver assembly including a receiver, a barrel and a bolt carrier, to a pump-action rifle, comprising:

a guide rail mounted along an axis parallel with the barrel and comprising a slot for receiving and guiding a pump hand grip;

the pump hand grip coaxially and slidably received by the barrel, said pump hand grip including a rectangular protrusion received by the slot in the guide rail to prevent rotation of said pump hand grip relative to the barrel;

a push rod which connects the pump hand grip with the bolt carrier;

a bolt carrier key joined to the push rod;

at least one threaded fastener a turnbuckle nut for attaching the push rod to the threaded fastener of the pump hand grip;

a modified gas block; and an aft support.

2. The kit of claim 1, wherein the kit fit comprises a modified barrel nut.

3. A system for converting a semiautomatic AR-platform rifle having an upper receiver assembly including a receiver, a barrel and a bolt carrier, to a pump-action rifle, comprising:

a guide rail mounted along an axis parallel with the barrel and comprising a slot for receiving and guiding a pump hand grip;

the pump hand grip coaxially and slidably received by the barrel, said pump hand grip including a rectangular protrusion received by the slot in the guide rail to prevent rotation of said pump hand grip relative to the barrel;

a push rod which connects the pump hand grip with the bolt carrier;

a bolt carrier key joined to the push rod;

at least one threaded fastener;

a turnbuckle nut for attaching the push rod to the threaded fastener of the pump hand grip;

a modified gas block; and an aft support.

4. The system of claim 3, further comprising:

a first member for being received on the barrel to provide a forward mounting support for said guide rail; and a second member for being received on the barrel to provide an aft mounting support for said guide rail.

5. The system of claim 4, wherein said first member includes the modified gas block, configured for having said guide rail mounted thereto.

6. The system of claim 4, wherein said second member includes a rail support configured for having said guide rail mounted thereto.

* * * * *